US009243844B2

(12) United States Patent
Yu

(10) Patent No.: US 9,243,844 B2
(45) Date of Patent: Jan. 26, 2016

(54) DRYER APPLIANCE WITH AN IMPELLER ASSEMBLY

(71) Applicant: General Electric Company, Schenectady, NY (US)

(72) Inventor: Zhiquan Yu, Mason, OH (US)

(73) Assignee: General Electric Company, Schenectady, NY (US)

( * ) Notice: Subject to any disclaimer, the term of this patent is extended or adjusted under 35 U.S.C. 154(b) by 140 days.

(21) Appl. No.: 14/228,334

(22) Filed: Mar. 28, 2014

(65) Prior Publication Data

US 2015/0276314 A1 Oct. 1, 2015

(51) Int. Cl.
*D06F 58/20* (2006.01)
*F26B 21/00* (2006.01)
*F26B 25/06* (2006.01)

(52) U.S. Cl.
CPC ..... *F26B 21/004* (2013.01); *F26B 25/06* (2013.01)

(58) Field of Classification Search
CPC ..... D06F 58/00; D06F 58/08; D06F 58/20; F26B 19/00; F26B 21/00; F26B 21/06; F01D 3/34; F01D 17/10
USPC ..... 34/595, 601, 606, 610; 68/5 C, 5 R, 19, 68/20; 8/149, 159; 416/186 R, 241 A
See application file for complete search history.

(56) References Cited

U.S. PATENT DOCUMENTS 3,504,444 A * 4/1970 Laue ..... D06F 58/02 34/131
3,831,292 A * 8/1974 DePas ..... D06F 58/24 261/90
3,940,861 A * 3/1976 Frazar ..... D06F 58/24 137/428
4,360,977 A * 11/1982 Frohbieter ..... D06F 58/20 165/7
5,701,684 A * 12/1997 Johnson ..... D06F 58/22 34/595
7,157,818 B2 1/2007 Jones
7,984,568 B2 * 7/2011 Dittmer ..... D06F 58/04 165/186
8,051,578 B2 * 11/2011 Kohlrusch ..... D06F 58/20 264/310
8,104,191 B2 * 1/2012 Ricklefs ..... D06F 58/203 34/474
8,261,466 B2 * 9/2012 Latack ..... D06F 58/04 34/601
9,057,153 B2 * 6/2015 Yu ..... D06F 58/10
2007/0062513 A1 * 3/2007 Gagas ..... F24C 15/2021 126/299 D
2014/0157613 A1 * 6/2014 McLain ..... F26B 3/04 34/139
2015/0276314 A1 * 10/2015 Yu ..... F26B 25/06 34/130

FOREIGN PATENT DOCUMENTS

CN 2701895 Y 5/2005
EP 1297772 4/2003
WO WO 2013020167 2/2013

* cited by examiner

*Primary Examiner* — Stephen M Gravini
(74) *Attorney, Agent, or Firm* — Dority & Manning, P.A.

(57) ABSTRACT

A dryer appliance includes an impeller assembly. The impeller assembly is rotatable about an axis of rotation in order to urge a flow of air through a drum of the dryer appliance. The impeller assembly includes a base plate, a plurality of blades and a plurality of extensions. The size and position of the plurality of extensions can assist with urging the flow of air through the drum of the dryer appliance.

20 Claims, 7 Drawing Sheets

DRYER APPLIANCE WITH AN IMPELLER ASSEMBLY

FIELD OF THE INVENTION

The present subject matter relates generally to impeller assemblies for appliances, e.g., dryer appliances.

BACKGROUND OF THE INVENTION

Dryer appliances generally include a cabinet with a drum rotatably mounted therein. A motor can selectively rotate the drum during operation of the dryer appliance, e.g., to tumble articles located within a chamber defined by the drum. Dryer appliances also generally include a heater assembly that passes heated air through the chamber of the drum in order to dry moisture laden articles disposed within the chamber.

To circulate heated air, certain dryer appliances include an impeller positioned within a housing. During operation of the dryer appliance, the impeller urges a flow of heated air into the chamber of the drum. Such heated air absorbs moisture from articles disposed within the chamber. The impeller also urges moisture laden air out of the chamber through a vent. The vent can be connected to household ductwork that directs the moisture laden air outdoors.

Performance of a dryer appliance can be affected by the flow of heated air. For example, dryer appliance performance can be improved by generating a large volume of heated air. Conversely, dryer appliance performance can be negatively affected if the heating assembly generates a low volume of heated air.

To improve dryer performance, a size of the impeller can be increased. However, space with a dryer appliance is generally limited or constrained. Thus, increasing a size of the impeller can be difficult. To improve dryer performance, certain dryer appliances include a second motor configured to rotate the impeller. However, motors can be expensive, and adding the second motor to the dryer appliance can increase the cost of the dryer appliance.

Accordingly, a dryer appliance with features for improving air flow through the dryer appliance would be useful. In particular, a dryer appliance with features for improving air flow through the dryer appliance without requiring a relatively large impeller or adding a second motor to the dryer appliance would be useful.

BRIEF DESCRIPTION OF THE INVENTION

The present subject matter provides a dryer appliance. The dryer appliance includes an impeller assembly. The impeller assembly is rotatable about an axis of rotation in order to urge a flow of air through a drum of the dryer appliance. The impeller assembly includes a base plate, a plurality of blades and a plurality of extensions. The size and position of the plurality of extensions can assist with urging the flow of air through the drum of the dryer appliance. Additional aspects and advantages of the invention will be set forth in part in the following description, or may be apparent from the description, or may be learned through practice of the invention.

In a first exemplary embodiment, a dryer appliance is provided. The dryer appliance includes a cabinet that defines a vent. A drum is rotatably mounted within the cabinet. The drum defines a chamber for receipt of articles for drying. A conduit connects the chamber of the drum and the vent of the cabinet such that the chamber of the drum and the vent of the cabinet are in fluid communication. The dryer appliance also includes a motor and an impeller assembly. The impeller assembly has an axis of rotation about which the impeller assembly is rotatable. The impeller assembly is in mechanical communication with the motor. The impeller assembly is rotatable about the axis of rotation by the motor in order to urge a flow of air from the chamber of the drum to the vent of the cabinet through the conduit. The impeller assembly defines a radial direction, a circumferential direction and an axial direction. The impeller assembly includes a base plate and a plurality of blades mounted to the base plate. Each blade of the plurality of blades extends from the base plate by a height, BH, along the axial direction. The blades of the plurality of blades are spaced apart from each other along the circumferential direction on the base plate. A plurality of extensions is mounted to the base plate. Each extension of the plurality of extensions extends between a leading portion and a trailing portion. The leading portion of each extension of the plurality of extensions is positioned adjacent the axis of rotation. The trailing portion of each extension of the plurality of extensions is positioned at a respective blade of the plurality of blades. Each extension of the plurality of extensions defines a radius, ER, between the leading portion and the trailing portion. The radius ER is less than the height BH.

In a second exemplary embodiment, a dryer appliance is provided. The dryer appliance includes a cabinet that defines a vent. A drum is rotatably mounted within the cabinet. The drum defines a chamber for receipt of articles for drying. A conduit connects the chamber of the drum and the vent of the cabinet such that the chamber of the drum and the vent of the cabinet are in fluid communication. The dryer appliance also includes a motor and an impeller assembly. The impeller assembly has an axis of rotation about which the impeller assembly is rotatable. The impeller assembly is in mechanical communication with the motor. The impeller assembly is rotatable about the axis of rotation by the motor in order to urge a flow of air from the chamber of the drum to the vent of the cabinet through the conduit. The impeller assembly defines a radial direction, a circumferential direction and an axial direction. The impeller assembly includes a base plate and a plurality of blades mounted to the base plate. The blades of the plurality of blades are spaced apart from each other along the circumferential direction on the base plate. A plurality of extensions is mounted to the base plate. Each extension of the plurality of extensions extends between a leading portion and a trailing portion. The leading portion of each extension of the plurality of extensions is positioned adjacent the axis of rotation. The trailing portion of each extension of the plurality of extensions is positioned at a respective blade of the plurality of blades. The leading portion of each extension of the plurality of extensions is spaced apart from the trailing portion of each extension of the plurality of extensions by a length, EL. The trailing portion of each extension of the plurality of extensions is also spaced apart from the axis of rotation along the radial direction by a radial length, RL. A ratio of the length EL to the radial length RL is greater than about two tenths and less than about eight tenths.

In a third exemplary embodiment, a dryer appliance is provided. The dryer appliance includes a cabinet that defines a vent. A drum is rotatably mounted within the cabinet. The drum defines a chamber for receipt of articles for drying. A conduit connects the chamber of the drum and the vent of the cabinet such that the chamber of the drum and the vent of the cabinet are in fluid communication. The dryer appliance also includes a motor and an impeller assembly. The impeller assembly has an axis of rotation about which the impeller assembly is rotatable. The impeller assembly is in mechanical communication with the motor. The impeller assembly is rotatable about the axis of rotation by the motor in order to urge a flow of air from the chamber of the drum to the vent of the cabinet through the conduit. The impeller assembly defines a radial direction, a circumferential direction and an axial direction. The impeller assembly includes a base plate and a plurality of blades mounted to the base plate. Each blade of the plurality of blades extends from the base plate by a height, BH, along the axial direction. The blades of the plurality of blades are spaced apart from each other along the circumferential direction on the base plate. A plurality of extensions is mounted to the base plate. Each extension of the plurality of extensions extends between a leading portion and a trailing portion. The leading portion of each extension of the plurality of extensions is positioned adjacent the axis of rotation. The trailing portion of each extension of the plurality of extensions is positioned at a respective blade of the plurality of blades. The trailing portion of each extension of the plurality of extensions defines a height, EH, along the axial direction. The height EH is less than the height BH.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
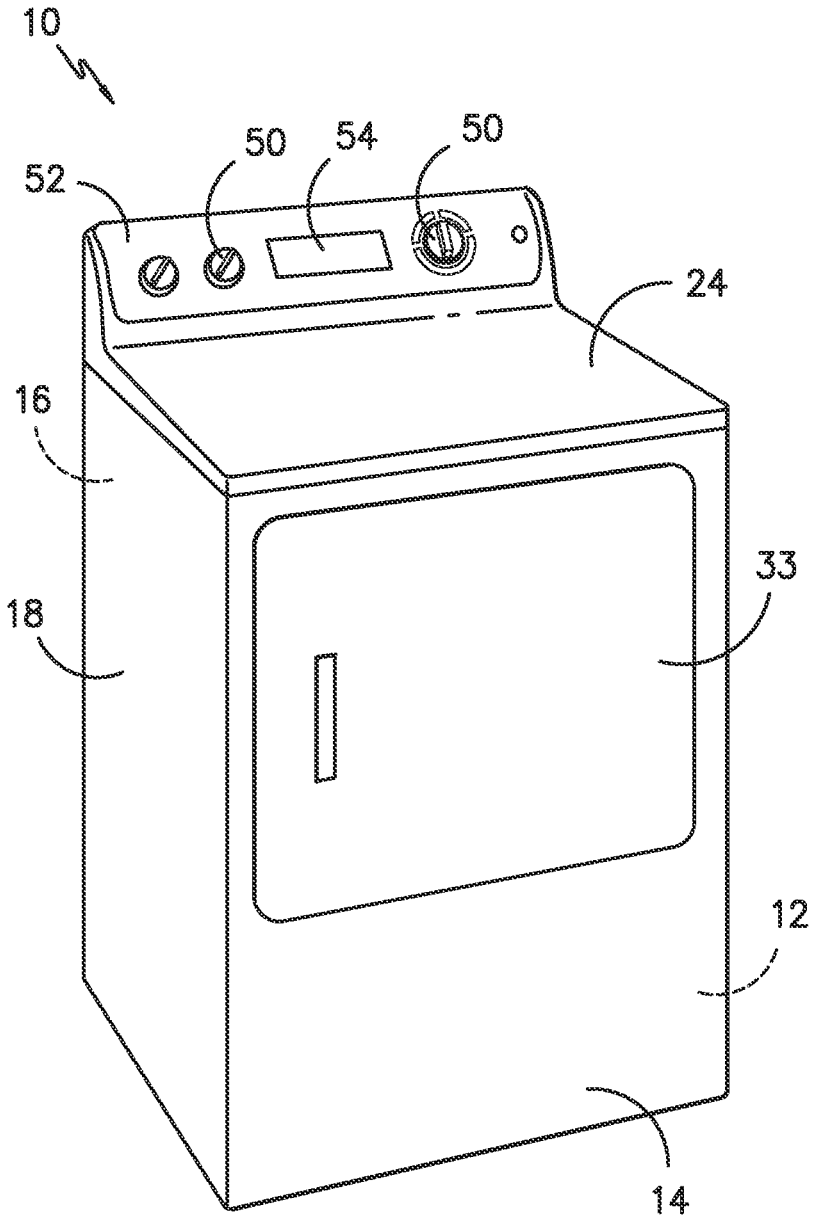
FIG. 1 provides a perspective view of a dryer appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to but need not be limited to fabrics, textiles, garments (or clothing), and linens. Furthermore, the term "load" or "laundry load" refers to the combination of articles that may be washed together in a washing machine or dried together in a laundry dryer (i.e., a clothes dryer) and may include a mixture of different or similar articles of different or similar types and kinds of fabrics, textiles, garments and linens within a particular laundering process.

Figure 2:
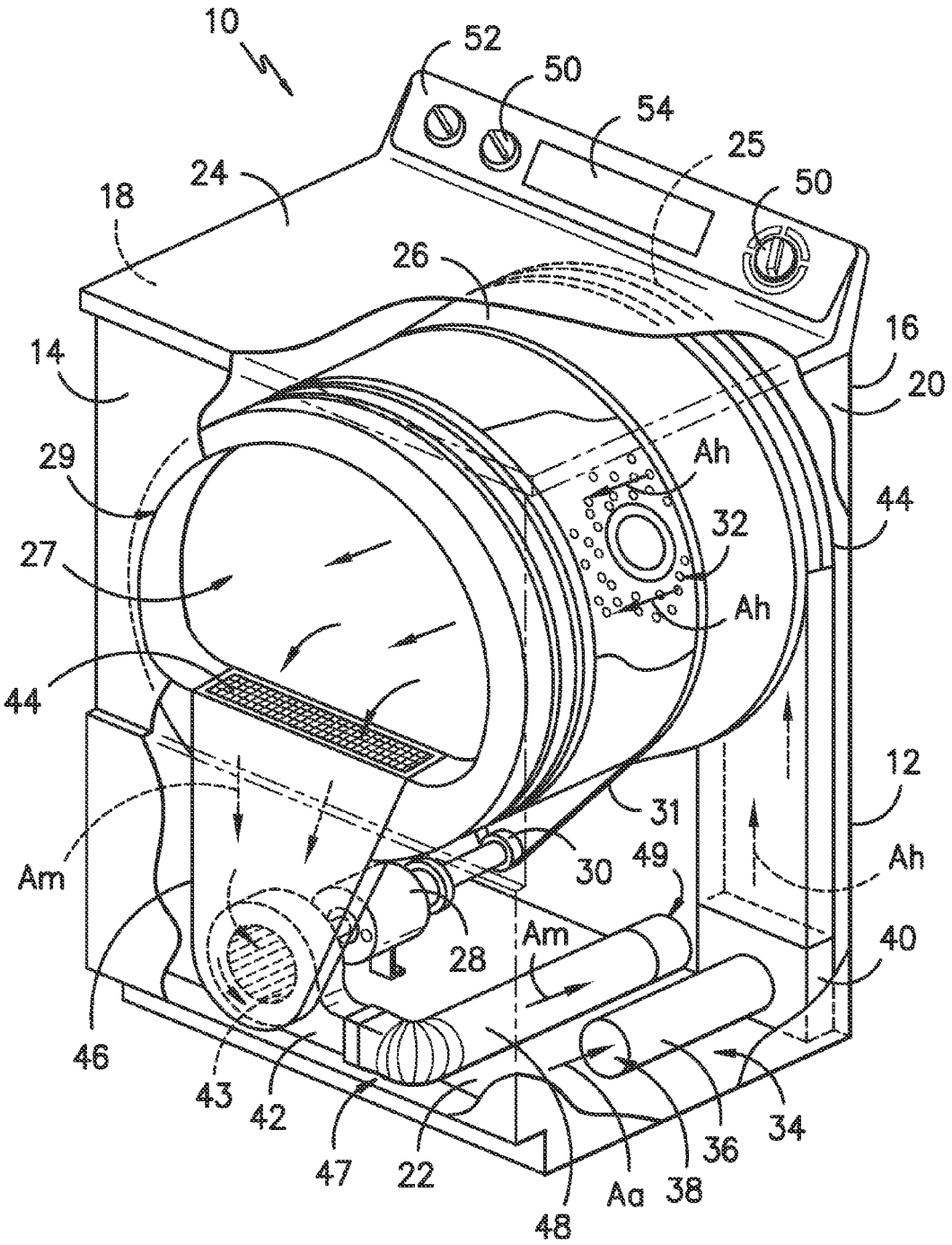
FIG. 2 provides a perspective view of the exemplary dryer appliance of FIG. 1 with a portion of a cabinet of the exemplary dryer appliance removed to reveal certain internal components of the exemplary dryer appliance.

FIGS. 1 and 2 illustrate a dryer appliance 10 according to an exemplary embodiment of the present subject matter. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For example, dryer appliance 10 illustrated in FIGS. 1 and 2 is a gas dryer appliance with a combustion chamber 36. In alternative exemplary embodiments, dryer appliance 10 may be an electric dryer appliance with electric heating elements replacing combustion chamber 36.

Dryer appliance 10 includes a cabinet 12 having a front panel 14, a rear panel 16, a pair of side panels 18 and 20 spaced apart from each other by front and rear panels 14 and 16, a bottom panel 22, and a top cover 24. Within cabinet 12 is a drum or container 26 mounted for rotation about a substantially horizontal axis. Drum 26 is generally cylindrical in shape and defines a chamber 27 for receipt of articles for drying.

Drum 26 also defines an opening 29 for permitting access to the chamber 27 of drum 26. Opening 29 of drum 26, e.g., permits loading and unloading of clothing articles and other fabrics from chamber 27 of drum 26. A door 33 is rotatably mounted at opening 29 and selectively hinders access to chamber 27 of drum 26 through opening 29.

Drum 26 includes a rear wall 25 rotatably supported within cabinet 12 by a suitable fixed bearing. Rear wall 25 can be fixed or can be rotatable. A motor 28 rotates the drum 26 about the horizontal axis through a pulley 30 and a belt 31. Motor 28 is also in mechanical communication with a fan or air handler 42 such that motor 28 rotates an impeller assembly 43, e.g., a centrifugal impeller assembly, of air handler 42. Air handler 42 is configured for drawing air through chamber 27 of drum 26, e.g., in order to dry articles located therein as discussed in greater detail below. In alternative exemplary embodiments, dryer appliance 10 may include an additional motor (not shown) for rotating impeller assembly 43 of air handler 42 independently of drum 26.

Drum 26 is configured to receive heated air that has been heated by a heater assembly 34, e.g., in order to dry damp articles disposed within chamber 27 of drum 26. Heater assembly 34 includes a combustion chamber 36. As discussed above, during operation of dryer appliance 10, motor 28 rotates drum 26 and impeller assembly 43 of air handler 42 such that air handler 42 draws air through chamber 27 of drum 26 when motor 28 rotates impeller assembly 43. In particular, ambient air, shown with arrow $A_a$, enters combustion chamber 36 via an inlet 38 due to air handler 42 urging such ambient air $A_a$ into inlet 38. Such ambient air $A_a$ is heated within combustion chamber 36 and exits combustion chamber 36 as heated air, shown with arrow $A_h$. Air handler 42 draws such heated air $A_h$ through a back duct 40 to drum 26.

The heated air $A_h$ enters drum 26 through a plurality of holes 32 defined in rear wall 25 of drum 26.

Within chamber 27, the heated air $A_h$ can accumulates moisture, e.g., from damp articles disposed within chamber 27. In turn, air handler 42 draws moisture laden air, shown as arrow $A_m$, through a screen filter 44 which traps lint particles. Such moisture laden air $A_m$ then enters a front duct 46 and is passed through air handler 42 to an exhaust duct 48. From exhaust duct 48, such moisture laden air $A_m$ passes out of clothes dryer 10 through a vent 49 defined by cabinet 12.

Front duct 46 and exhaust duct 48 form a conduit 47 that extends between and connects chamber 27 of drum 26 and vent 49. Conduit 47 places chamber 27 of drum 26 and vent 49 in fluid communication in order to permit moisture laden air $A_m$ to exit dryer appliance 10. Air handler 42 is in fluid communication with conduit 47, and impeller assembly 43 of air handler 42 is positioned within conduit 47.

A cycle selector knob 50 is mounted on a cabinet backsplash 52 and is in communication with a controller 54. Signals generated in controller 54 operate motor 28 and heater assembly 34 in response to a position of selector knob 50. Alternatively, a touch screen type interface may be provided. As used herein, "processing device" or "controller" may refer to one or more microprocessors or semiconductor devices and is not restricted necessarily to a single element. The processing device can be programmed to operate dryer appliance 10. The processing device may include, or be associated with, one or memory elements such as e.g., electrically erasable, programmable read only memory (EEPROM).

Figure 3:
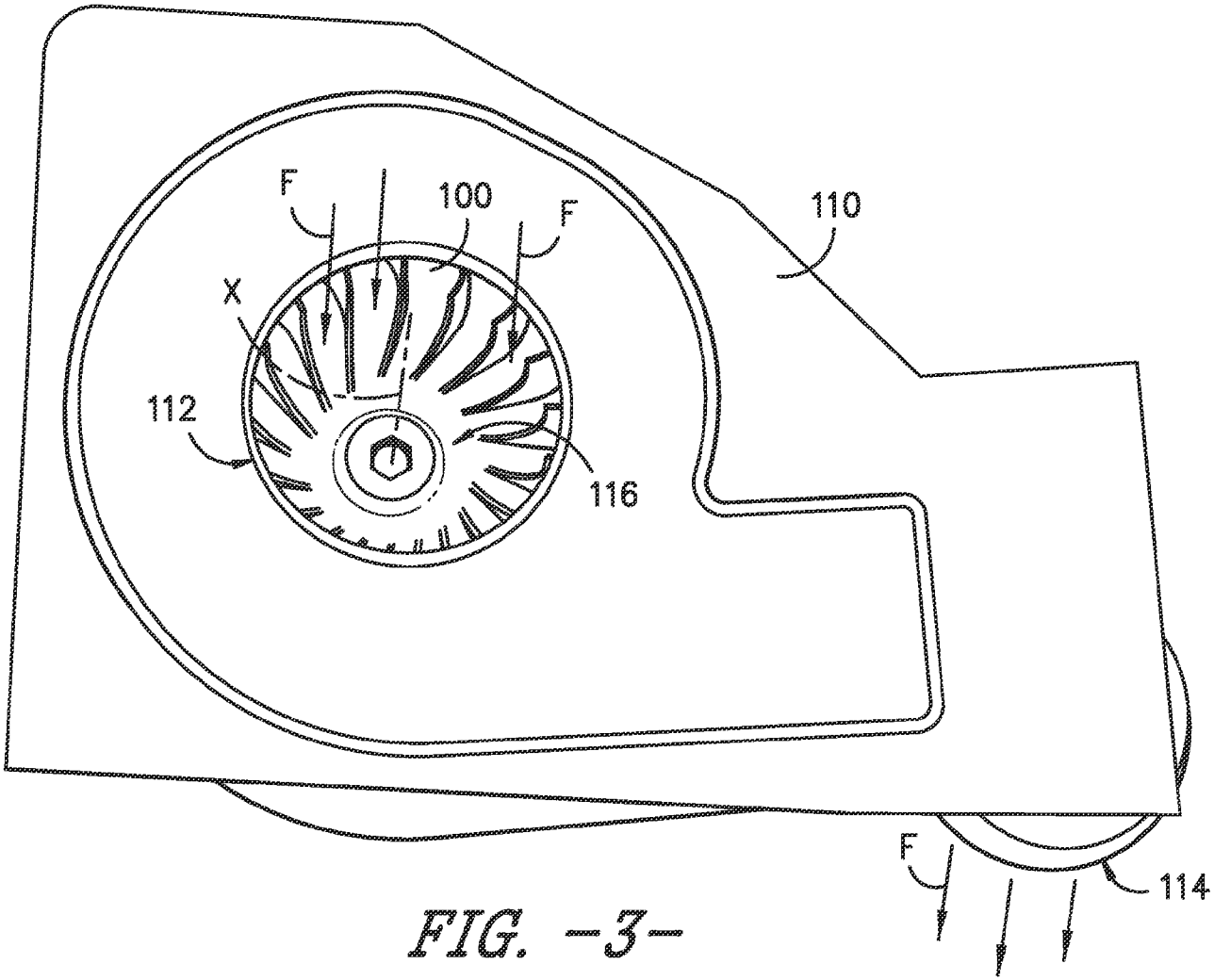
FIG. 3 provides a perspective view of an impeller assembly according to an exemplary embodiment of the present subject matter mounted within a casing.

FIG. 3 provides a perspective view of a blade wheel or impeller assembly 100 according to an exemplary embodiment of the present subject matter mounted within a housing or casing 110. Impeller assembly 100 and casing 110 may be used with any suitable dryer appliance. As an example, impeller assembly 100 may be used in dryer appliance 10 as impeller assembly 43 (FIG. 2). Impeller assembly 100 includes features for drawing sufficient heated air into chamber 27 of drum 26, e.g., in order to dry articles therein.

Casing 110 defines an inlet 112, an outlet 114 and a flow passage 116. Flow passage 116 extends between inlet 112 of casing 110 and outlet 114 of casing 110. Thus, flow passage 116 places inlet 112 of casing 110 in fluid communication with outlet 114 of casing 110 such that flows of air (shown with arrows F) can enter casing 110 at inlet 112 of casing 110 and flow into flow passage 116. Inlet 112 of casing 110 may be positioned at or mounted to front duct 46 of dryer appliance 10 in order to receive moisture laden air $A_m$ from chamber 27 of drum 26. Flows of air F can flow through casing 110 in flow passage 116 to outlet 114 of casing 110. At outlet 114 of casing 110, flows of air F can exit casing 110. Outlet 114 of casing 110 may be positioned at or mounted to exhaust duct 48 of dryer appliance 10 in order to direct moisture laden air $A_m$ out of casing 110 and/or dryer appliance 10.

Impeller assembly 100 is position within casing 110, e.g., within flow passage 116. Impeller assembly 100 has an axis of rotation X about or on which impeller assembly 100 is rotatable. When impeller assembly 100 is rotating about the axis of rotation X, impeller assembly 100 draws or urges flows of air F into casing 110, e.g., in the manner described above. Impeller assembly 100 may be in mechanical communication with motor 28 of dryer appliance 10. Thus, impeller assembly 100 may be rotatable about the axis of rotation X by motor 28 in order to urge flows of air F into casing 110. In particular, motor 28 can rotate or spin impeller assembly 100 on the axis of rotation X in order to draw moisture laden air $A_m$ from chamber 27 of drum 26 and urge moisture laden air $A_m$ to vent 49 of cabinet 12 in the manner described above. It should be understood that impeller assembly 100 may be rotatable about the axis of rotation X by any suitable motor. For example, dryer appliance 10 may include an additional motor (not shown) that can rotate impeller assembly 100 independently of drum 26.

Figure 4:
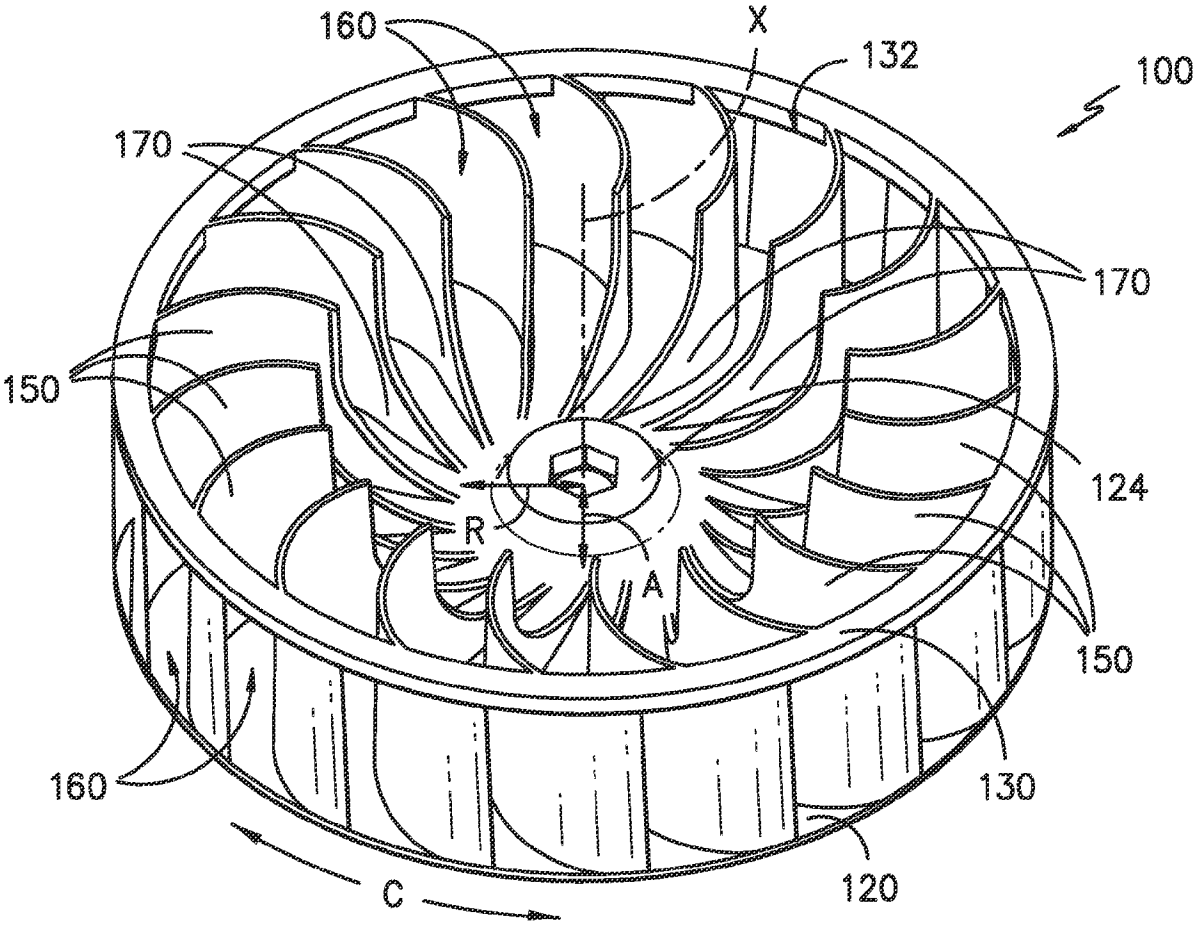
FIG. 4 provides a perspective view of the exemplary impeller assembly of FIG. 3.

FIG. 4 provides a perspective view of impeller assembly 100. As may be seen in FIG. 4, impeller assembly 100 defines a radial direction R, a circumferential direction C and an axial direction A. The axis of rotation X may be substantially parallel to the axial direction A, e.g., such that the axis of rotation X is substantially perpendicular to the radial direction R and circumferential direction C. Impeller assembly 100 includes a base plate 120, an annular front plate 130 and a plurality of blades 150. Base plate 120, annular front plate 130 and blades 150 define a plurality of passages 160 for directing flows of air F during rotation of impeller assembly 100 about the axis of rotation X.

Base plate 120 has a substantially circular shape, e.g., in a plane that is perpendicular to the axial direction A, such that base plate 120 is substantially disk-shaped. Base plate 120 includes a mounting feature 124 for mounting base plate 120 to a motor, such as motor 28, or a rotational shaft, such as a pulley structure shaft. Mounting feature 124 is positioned at the axis of rotation X and can be any suitable mechanism for mounting impeller assembly 100 to the motor. For example, mounting feature 124 may include threads for securing impeller assembly 100 to the motor.

Annular front plate 130 is spaced apart from base plate 120, e.g., along the axial direction A. Further, annular front plate 130 is positioned up stream of base plate 120 relative to flow of air F (FIG. 3) Annular front plate 130 is substantially ring-shaped e.g., in a plane that is perpendicular to the axial direction A. Thus, annular front plate 130 defines an opening 132 that permits flow of air F therethrough during rotation of impeller assembly 100 about the axis of rotation X.

Blades 150 extend between base plate 120 and annular front plate 130, e.g., along the axial direction A. Thus, base plate 120 and annular front plate 130 may be coupled together with blades 150. Blades 150 are spaced apart from each other, e.g., along the circumferential direction C. In particular, blades 150 may be spaced apart from each other such that blades 150 are uniformly dispersed or distributed along the circumferential direction C. Base plate 120, annular front plate 130 and blades 150 are sized, shaped and oriented for drawing flows of air F during rotation of impeller assembly 100 about the axis of rotation X, as discussed in greater detail below.

As may be seen in FIG. 4, impeller assembly 100 also includes a plurality of extensions 170. Extensions 170 are mounted base plate 120, and each extension of extensions 170 is positioned at or adjacent a respective one of blades 150. Extensions 170 may assist with urging and directing air flow F during rotation of impeller assembly 100 about the axis of rotation X.

Figure 5:
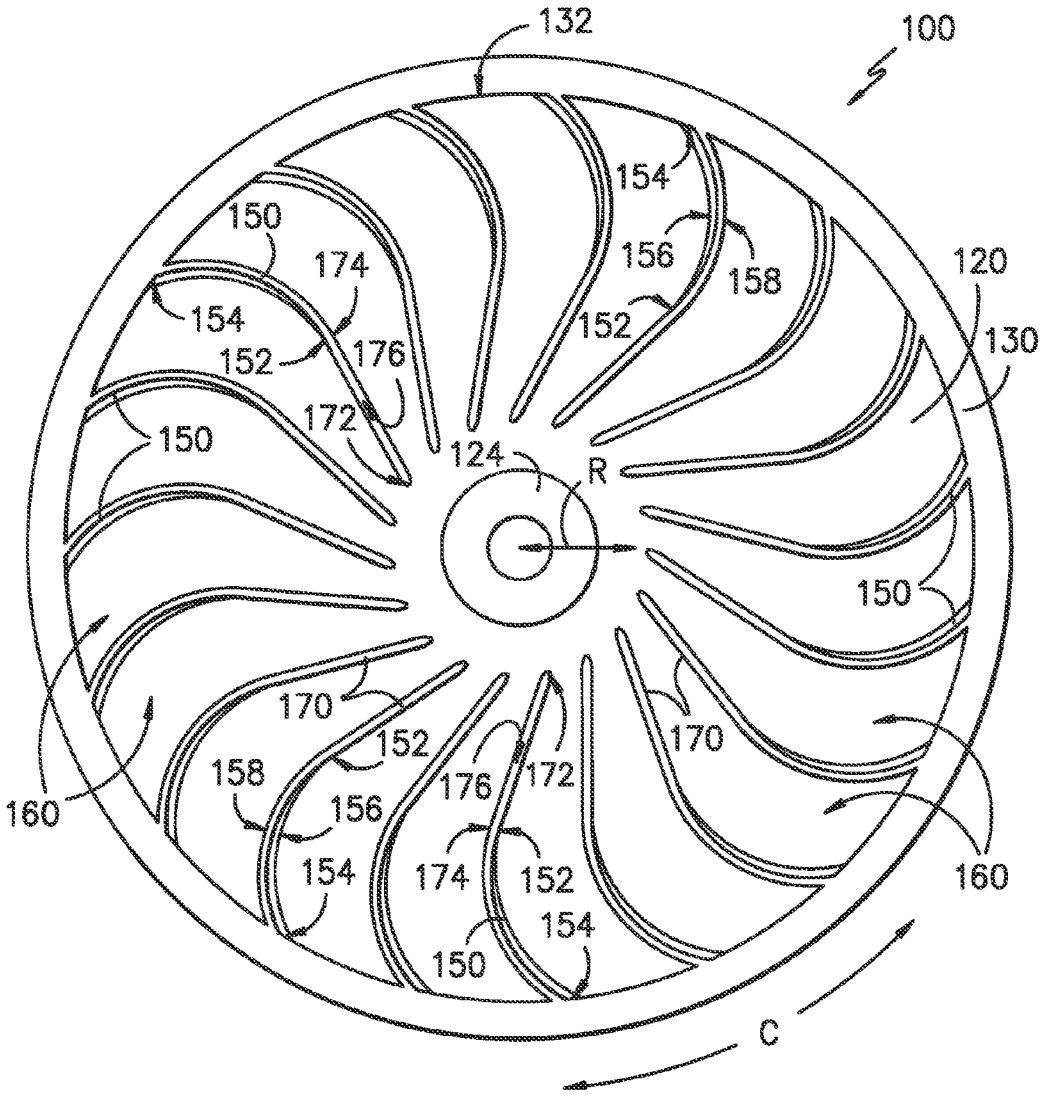
FIG. 5 provides a top, plan view of the exemplary impeller assembly of FIG. 3.

FIG. 5 provides a top, plan view of impeller assembly 100. As may be seen in FIG. 5, each blade of blades 150 extends between an inner or leading edge 152 and an outer or trailing edge 154, e.g., along the radial direction R. Further, each blade of blades 150 defines an arcuate or curved shape, e.g., in a plane that is perpendicular to the axial direction A, between about the leading and trailing edges 152 and 154 of each blade. Thus, each blade of blades 150 includes a concave surface 156 and a convex surface 158 positioned on opposite sides of each blade such that the concave and convex surfaces 156 and 158 of each blade are spaced apart from each other along the circumferential direction C. As may be seen in FIG. 5, concave surface 156 of one of blades 150 and convex surface 158 of an adjacent one of blades 150 define one of passages 160 therebetween. The arcuate or curved shape of blades 150 can assist with urging flows of air F through passages 160 during rotation of impeller assembly 100 about the axis of rotation X.

As may be seen in FIG. 5, each of extensions 170 extends between a leading portion 172 and a trailing portion 174. Leading portions 172 of extensions 170 are positioned adjacent the axis of rotation X. Conversely, each trailing portion 174 is positioned at a respective blade of blades 150. In particular, each trailing portion 174 may be mounted or secured to the respective one of blades 150 at the leading edge 152 of the respective one of blades 150. Extensions 170 may extend linearly between leading portion 172 and trailing portion 174, e.g., in a plane that is perpendicular to the axial direction A. However, in alternative exemplary embodiments, extensions 170 may be curved between leading portion 172 and trailing portion 174, e.g., in the plane that is perpendicular to the axial direction A. In addition, leading portion 172 and trailing portion 174 of each extension 170 may be spaced apart or offset from each other along at least one of the radial direction R and the circumferential direction C.

Figure 6:
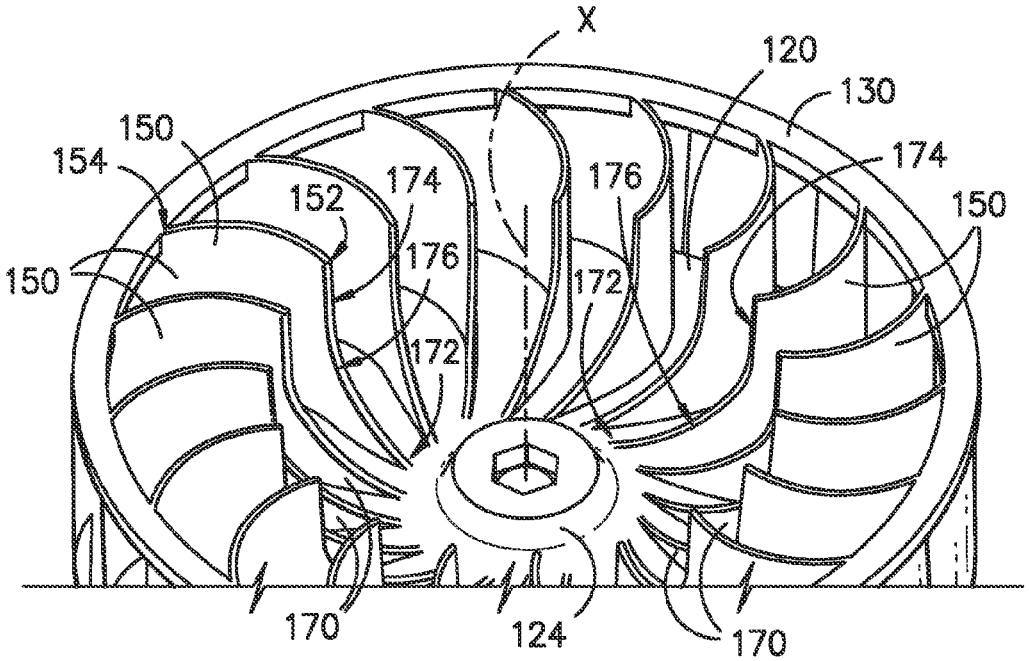
FIG. 6 provides a partial, perspective view of the exemplary impeller assembly of FIG. 3.

FIG. 6 provides a partial, perspective view of impeller assembly 100. As may be seen FIG. 6, leading portions 172 of extensions 170 are positioned at or adjacent base plate 120. Thus, a top edge 176 of extensions 170 tapers upwardly or increases in height from leading portion 172 to trailing portion 174.

Figure 7:
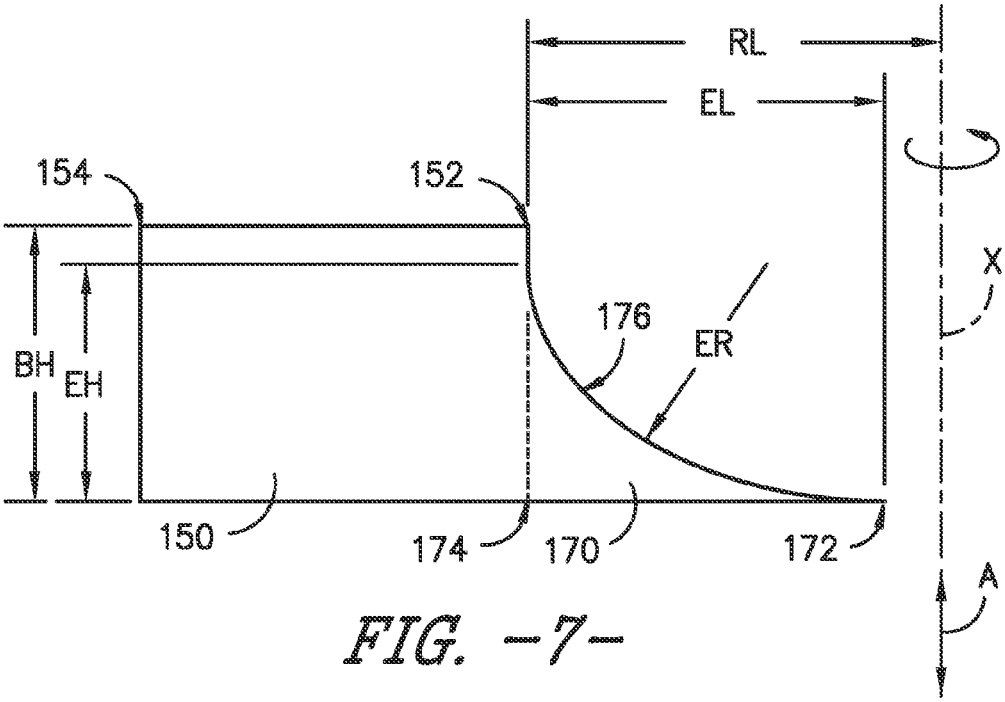
FIG. 7 provides a side, elevation view of a blade of the exemplary impeller assembly of FIG. 3.

FIG. 7 provides a side, elevation view of one of blades 150 of impeller assembly 100. As may be seen in FIG. 7, blade 150 extends from base plate 120 and defines a height, BH, e.g., along the axial direction A. Thus, base plate 120 and annular front plate 130 may be spaced apart from each other by about the height BH, e.g., along the axial direction A. The height BH may be any suitable height. For example, the height BH may be greater than about one inch and less than about four inches.

Extension 170 also defines a radius, ER, between leading portion 172 and trailing portion 174. In particular, top edge 176 of extension 170 may extend between leading portion 172 and trailing portion 174 of extension 170 and define the radius ER. The radius ER may be any suitable radius. For example, the radius ER may be greater than about half an inch and less than about four inches. In addition, the radius ER may be less than the height BH. In particular, a ratio of the radius ER to the height BH may be greater than about one quarter (0.25) and less than about nine tenths (0.9).

As may be seen in FIG. 7, leading portion 172 of extension 170 is spaced apart from trailing portion 174 of extension 170 by a length, EL, e.g., along at least one of the radial direction R and the circumferential direction C. Thus, extension 170 may extend along at least one of the radial direction R and the circumferential direction C by the length EL. The length EL may be any suitable length. For example, the length EL may be greater than about half an inch and less than about four inches.

Trailing portion 174 of extension 170 is also spaced apart from the axis of rotation X by a radial length, RL, e.g., along the radial direction R. The radial length RL may be any suitable length. For example, the radial length RL may be greater than about two inches and less than about six inches. In addition, a ratio of the length EL to the radial length RL may be greater than about two tenths (0.2) and less than about eight tenths (0.8).

As may be seen in FIG. 7, trailing portion 174 of extension 170 defines a height, EH, e.g., along the axial direction A. The height EH may be any suitable height. For example, the height EH may be greater than about an eighth of an inch and less than about three and one half inches. In addition, the height EH may be less than the height BH. In particular, a ratio of the height EH to the height BH may be greater than about one tenth (0.1) and less than about eight tenths (0.8).

As discussed above, blades 150 and extensions 170 are sized, shaped and oriented for drawing flows of air F during rotation of impeller assembly 100 about the axis of rotation X. In particular, proper selection of the ratio of the radius ER to the height BH, the ratio of the length EL to the radial length RL and/or the ratio of the height EH to the height BH can assist with drawing flows of air F during rotation of impeller assembly 100 about the axis of rotation X. For example, such sizing, shaping and orientation can assist with providing a relatively high pressure rise in flows of air F and relatively large flow rates for flows of air F.

In the exemplary embodiment shown in FIGS. 6 and 7, top edge 176 of extension 170 defines a constant radius between leading portion 172 and trailing portion 174. It should be understood that top edge 176 of extension 170 may have any other suitable shape or curvature in alternative exemplary embodiments. For example, top edge 176 of extension 170 may define multiple radii. As another example, top edge 176 of extension 170 may define a smooth and/or continuous sinuous shape.

Figure 8:
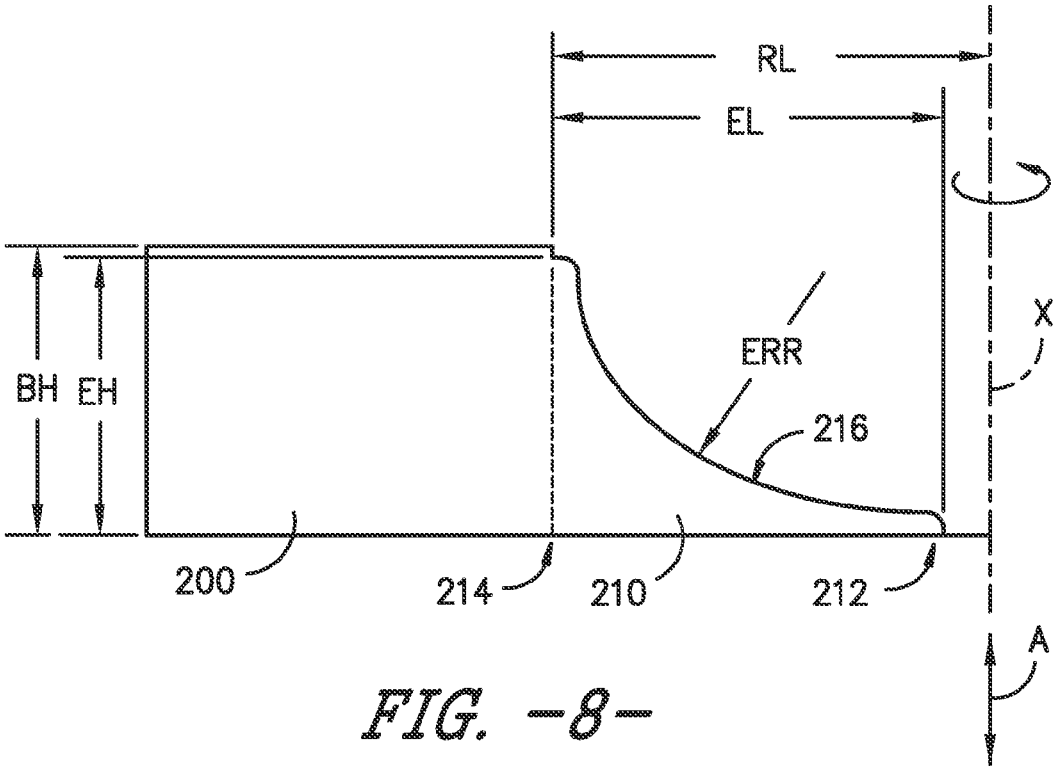
FIG. 8 provides a side, elevation view of a blade according to another exemplary embodiment of the present subject matter.

FIG. 8 provides a side, elevation view of a blade 200 and extension 210 according to another exemplary embodiment of the present subject matter. Blade 200 and extension 210 may be used in any suitable impeller assembly. For example, blade 200 and extension 210 may be used in or with impeller assembly 100 (FIG. 4), such that blade 200 is mounted to base plate 120 of impeller assembly 100.

Extension 210 extends between a leading portion 212 and a trailing portion 214. As may be seen in FIG. 8, extension 210 also defines a radius, ERR. In particular, a top edge 216 of extension 210 may extend between leading portion 212 and trailing portion 214 of extension 210 and define the radius ERR. In addition, top edge 216 of extension 210 defines transitions radii at leading portion 212 and trailing portion 214, respectively. Thus, top edge 216 of extension 210 defines multiple radii. It should be understood that top edge 216 of extension 210 may have any other suitable shape or curvature in alternative exemplary embodiments. For example, top edge 216 of extension 210 may define additional radii. As another example, top edge 216 of extension 210 may define a smooth and/or continuous sinuous shape.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet defining a vent;

a drum rotatably mounted within the cabinet, the drum defining a chamber for receipt of articles for drying;

a conduit that connects the chamber of the drum and the vent of the cabinet such that the chamber of the drum and the vent of the cabinet are in fluid communication;

a motor; and an impeller assembly, the impeller assembly having an axis of rotation about which the impeller assembly is rotatable, the impeller assembly being in mechanical communication with the motor; the impeller assembly rotatable about the axis of rotation by the motor in order to urge a flow of air from the chamber of the drum to the vent of the cabinet through the conduit, the impeller assembly defining a radial direction, a circumferential direction and an axial direction, the impeller assembly comprising:

a base plate; and a plurality of blades mounted to the base plate, each blade of the plurality of blades extending from the base plate by a height, BH, along the axial direction, the blades of the plurality of blades spaced apart from each other along the circumferential direction on the base plate;

a plurality of extensions mounted to the base plate, each extension of the plurality of extensions extending between a leading portion and a trailing portion, the leading portion of each extension of the plurality of extensions positioned adjacent the axis of rotation, the trailing portion of each extension of the plurality of extensions positioned at a respective blade of the plurality of blades, each extension of the plurality of extensions defining a radius, ER, between the leading portion and the trailing portion, the radius ER being less than the height BH.

2. The dryer appliance of claim 1, wherein a ratio of the radius ER to the height BH is greater than about one quarter and less than about nine tenths.

3. The dryer appliance of claim 1, wherein each leading portion of the plurality of extensions is offset from a respective trailing portion of the plurality of extensions along the radial direction and the circumferential direction.

4. The dryer appliance of claim 1, wherein the base plate is mounted to the motor.

5. The dryer appliance of claim 1, wherein the motor is in mechanical communication with the drum and is configured for rotating the drum.

6. The dryer appliance of claim 1, wherein each blade of the plurality of blades defines an arcuate shape in a plane that is perpendicular to the axial direction.

7. The dryer appliance of claim 1, wherein each extension of the plurality of extensions extends linearly between the leading portion of each extension of the plurality of extensions and the trailing portion of each extension of the plurality of extensions.

8. A dryer appliance, comprising:

a cabinet defining a vent;

a drum rotatably mounted within the cabinet, the drum defining a chamber for receipt of articles for drying;

a conduit that connects the chamber of the drum and the vent of the cabinet such that the chamber of the drum and the vent of the cabinet are in fluid communication;

a motor; and an impeller assembly, the impeller assembly having an axis of rotation about which the impeller assembly is rotatable, the impeller assembly being in mechanical communication with the motor; the impeller assembly rotatable about the axis of rotation by the motor in order to urge a flow of air from the chamber of the drum to the vent of the cabinet through the conduit, the impeller assembly defining a radial direction, a circumferential direction and an axial direction, the impeller assembly comprising:

a base plate; and a plurality of blades mounted to the base plate, the blades of the plurality of blades spaced apart from each other along the circumferential direction on the base plate;

a plurality of extensions mounted to the base plate, each extension of the plurality of extensions extending between a leading portion and a trailing portion, the leading portion of each extension of the plurality of extensions positioned adjacent the axis of rotation, the trailing portion of each extension of the plurality of extensions positioned at a respective blade of the plurality of blades, the leading portion of each extension of the plurality of extensions spaced apart from the trailing portion of each extension of the plurality of extensions by a length, EL, the trailing portion of each extension of the plurality of extensions also spaced apart from the axis of rotation along the radial direction by a radial length, RL, a ratio of the length EL to the radial length RL being greater than about two tenths and less than about eight tenths.

9. The dryer appliance of claim 8, wherein each leading portion of the plurality of extensions is offset from a respective trailing portion of the plurality of extensions along the radial direction and the circumferential direction.

10. The dryer appliance of claim 8, wherein the base plate is mounted to the motor.

11. The dryer appliance of claim 8, wherein the motor is in mechanical communication with the drum and is configured for rotating the drum.

12. The dryer appliance of claim 8, wherein each blade of the plurality of blades defines an arcuate shape in a plane that is perpendicular to the axial direction.

13. The dryer appliance of claim 8, wherein each extension of the plurality of extensions extends linearly between the leading portion of each extension of the plurality of extensions and the trailing portion of each extension of the plurality of extensions.

14. A dryer appliance, comprising:

a cabinet defining a vent;

a drum rotatably mounted within the cabinet, the drum defining a chamber for receipt of articles for drying;

a conduit that connects the chamber of the drum and the vent of the cabinet such that the chamber of the drum and the vent of the cabinet are in fluid communication;

a motor; and an impeller assembly, the impeller assembly having an axis of rotation about which the impeller assembly is rotatable, the impeller assembly being in mechanical communication with the motor; the impeller assembly rotatable about the axis of rotation by the motor in order to urge a flow of air from the chamber of the drum to the vent of the cabinet through the conduit, the impeller assembly defining a radial direction, a circumferential direction and an axial direction, the impeller assembly comprising:

a base plate; and a plurality of blades mounted to the base plate, each blade of the plurality of blades extending from the base plate by a height, BH, along the axial direction, the blades of the plurality of blades spaced apart from each other along the circumferential direction on the base plate;

a plurality of extensions mounted to the base plate, each extension of the plurality of extensions extending between a leading portion and a trailing portion, the leading portion of each extension of the plurality of extensions positioned adjacent the axis of rotation, the trailing portion of each extension of the plurality of extensions positioned at a respective blade of the plurality of blades, the trailing portion of each extension of the plurality of extensions defining a height, EH, along the axial direction, the height EH being less than the height BH.

15. The dryer appliance of claim 14, wherein a ratio of the height EH to the height BH is greater than about one tenth and less than about eight tenths.

16. The dryer appliance of claim 14, wherein each leading portion of the plurality of extensions is offset from a respective trailing portion of the plurality of extensions along the radial direction and the circumferential direction.

17. The dryer appliance of claim 14, wherein the base plate is mounted to the motor.

18. The dryer appliance of claim 14, wherein the motor is in mechanical communication with the drum and is configured for rotating the drum.

19. The dryer appliance of claim 14, wherein each blade of the plurality of blades defines an arcuate shape in a plane that is perpendicular to the axial direction.

20. The dryer appliance of claim 14, wherein each extension of the plurality of extensions extends linearly between the leading portion of each extension of the plurality of extensions and the trailing portion of each extension of the plurality of extensions.

* * * * *